US006062345A

United States Patent [19]

Olofsson

[11] Patent Number: 6,062,345

[45] Date of Patent: May 16, 2000

[54] ELEVATOR INTERLOCKING MECHANISM

[75] Inventor: Mats Olofsson, Skellefteå, Sweden

[73] Assignee: Alimak AB, Skelleftea, Sweden

[21] Appl. No.: 09/077,198

[22] PCT Filed: Dec. 3, 1996

[86] PCT No.: PCT/SE96/01592

§ 371 Date: May 26, 1998

§ 102(e) Date: May 26, 1998

[87] PCT Pub. No.: WO97/20766

PCT Pub. Date: Jun. 12, 1997

[30] Foreign Application Priority Data

Dec. 4, 1995 [SE] Sweden ..... 9504351

[51] Int. Cl.[7] ..... B66B 13/12

[52] U.S. Cl. ..... 187/309; 187/330; 187/319; 187/333

[58] Field of Search ..... 187/313, 330, 187/331, 333, 334, 319, 309; 70/275

[56] References Cited

U.S. PATENT DOCUMENTS

| | | | |
|---|---|---|---|
| 1,444,313 | 2/1923 | Hartman | 187/319 |
| 2,218,068 | 10/1940 | Klein | 187/334 |
| 3,065,826 | 11/1962 | Tucker, Jr. | 187/319 |
| 3,315,767 | 4/1967 | Walter | 187/319 |
| 4,436,184 | 3/1984 | Dorman et al. | 187/331 |
| 4,454,931 | 6/1984 | Leinar et al. | 187/319 |
| 5,139,112 | 8/1992 | Tonna et al. | 187/331 |
| 5,207,298 | 5/1993 | Donohoe et al. | 187/313 |
| 5,454,447 | 10/1995 | Kulak et al. | 187/331 |
| 5,669,465 | 9/1997 | Kulak et al. | 187/331 |

FOREIGN PATENT DOCUMENTS

| | | | |
|---|---|---|---|
| 5-132272 | 5/1993 | Japan | 187/330 |
| 353061 | 1/1973 | Sweden . | |

*Primary Examiner*—Robert P. Olszewski
*Assistant Examiner*—Thuy V. Tran
*Attorney, Agent, or Firm*—Nixon & Vanderhye P.C.

[57] ABSTRACT

An elevator interlocking mechanism interlocks the elevator cage door and each landing door, and includes a release mechanism for release of the interlocks when the elevator cage is at rest at a landing. The elevator cage interlock comprises an elevator door locking rod which in a locking position engages a lock pin to prevent the elevator cage door from being opened. Each landing interlock includes a corresponding landing door locking rod which in a locking position engages a locking pin, which prevents the landing door from being opened. The locking rods are jointly operated by a single operating device so that the operating device—at a proper landing position—displaces the elevator locking rod from its locking position, and in turn the locking rod displaces a landing door locking rod from its position using a cam.

5 Claims, 3 Drawing Sheets

ELEVATOR INTERLOCKING MECHANISM

Figure 1:
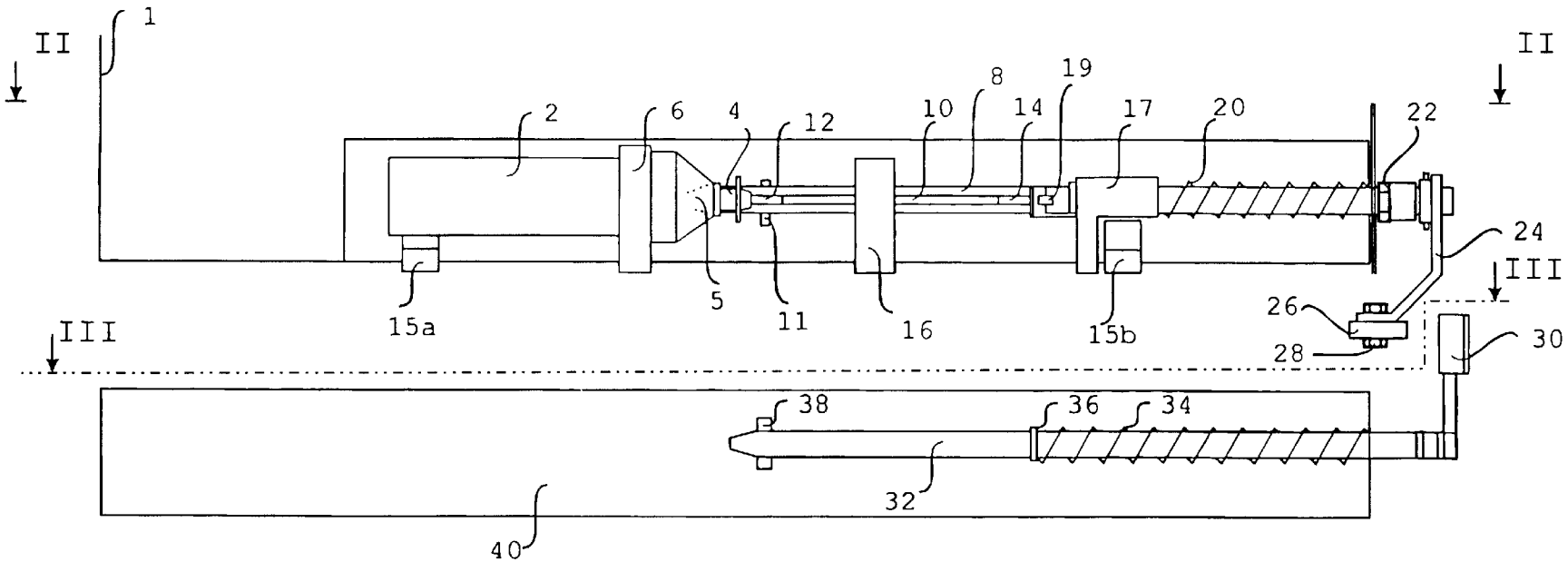

The invention relates to an elevator interlocking mechanism, comprising a lift cage door having interlocking of the lift cage door, and a landing door at each landing having interlocking of the landing door, said doors being interlocked, when the lift cage is moving, the interlocking of the lift cage door and the interlocking of a landing door may be released when the lift cage is at rest at the respective landing of said landing door.

Prior art lifts have been provided with various locking mechanisms for preventing the lift cage door or the landing doors from being opened, when the lift cage is in motion or beyond a landing. These prior solutions of the above problems have always comprised a more or less complex separate interlocking mechanism for the lift cage door and a separate interlocking mechanism for each landing, said interlocking mechanisms being independently operated. In general various, fix cams, provided at each landing, have been used, which act on movable cam roll, associated with the lift or vice versa, by means of which the interlockings of the doors are released, so that the doors could be opened.

The disadvantages of prior art are that it requires a great precision in the manufacture and mounting of the various components involved. Furthermore, the number of members of the prior mechanisms is rather big, resulting in quite a high cost of assembly for these parts. Further, the big number of precisionmade members implies that the locking mechanisms will become relatively sensitive to wear and dirt, leading to a non neglectable cost of maintenance.

The object of the invention is to provide an interlocking mechanism of the kind indicated above and in the preamble of claim 1, which avoids those above discussed disadvantages, includes a significantly less total number of components than other mechanisms for this purpose, is wear resistant, and may be produced at a lower cost than before.

This object is solved according to the invention in a mechanism of the kind defined in the preamble of claim 1, which comprises the features, defined in the characterizing part of claim 1.

By these measures only one operating mechanism need be provided in the lift cage for operating the interlocking of the lift cage and all interlockings of the landings (of course, not all simultaneously). Thus, the number of members involved may significantly be reduced in relation to prior solutions.

Further, the reduced requirements of accuracy in the positioning of the cams result in a quicker and simplified installation of the complete elevator system and in less costs as a consequence.

It should be noted that "door" in this connection includes all types of doors, that can be interlocked in a lift cage and at landings, single and double side hung doors, as well as vertical and horizontal push doors.

Hereinafter a preferred embodiment of the invention will be explained more in detail. It should be noted that for the sake of clarity only those details, which are necessary for the understanding of the principles of invention, are explained and illustated in the drawings. In addition to this, the components involved are only schematically shown, thus, the drawings are not machine drawings.

Figure 2:
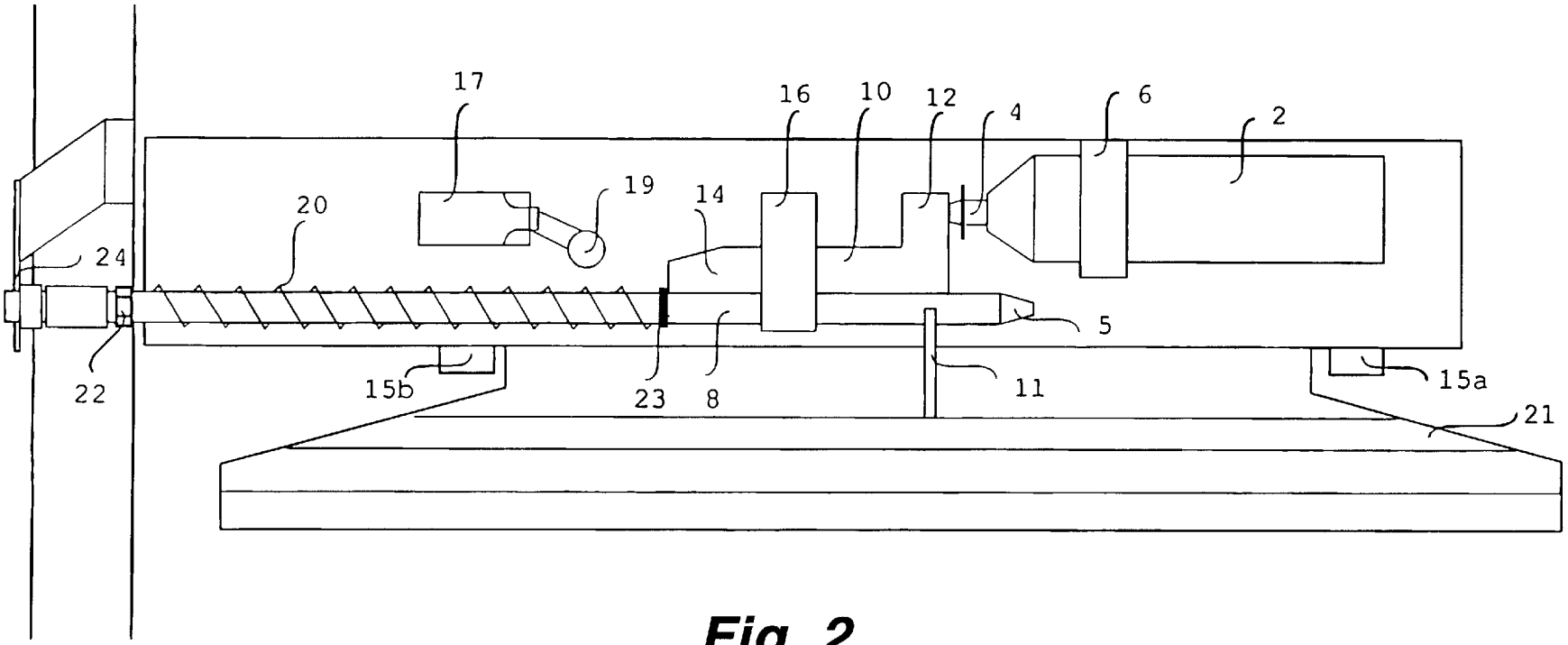
Figure 3:
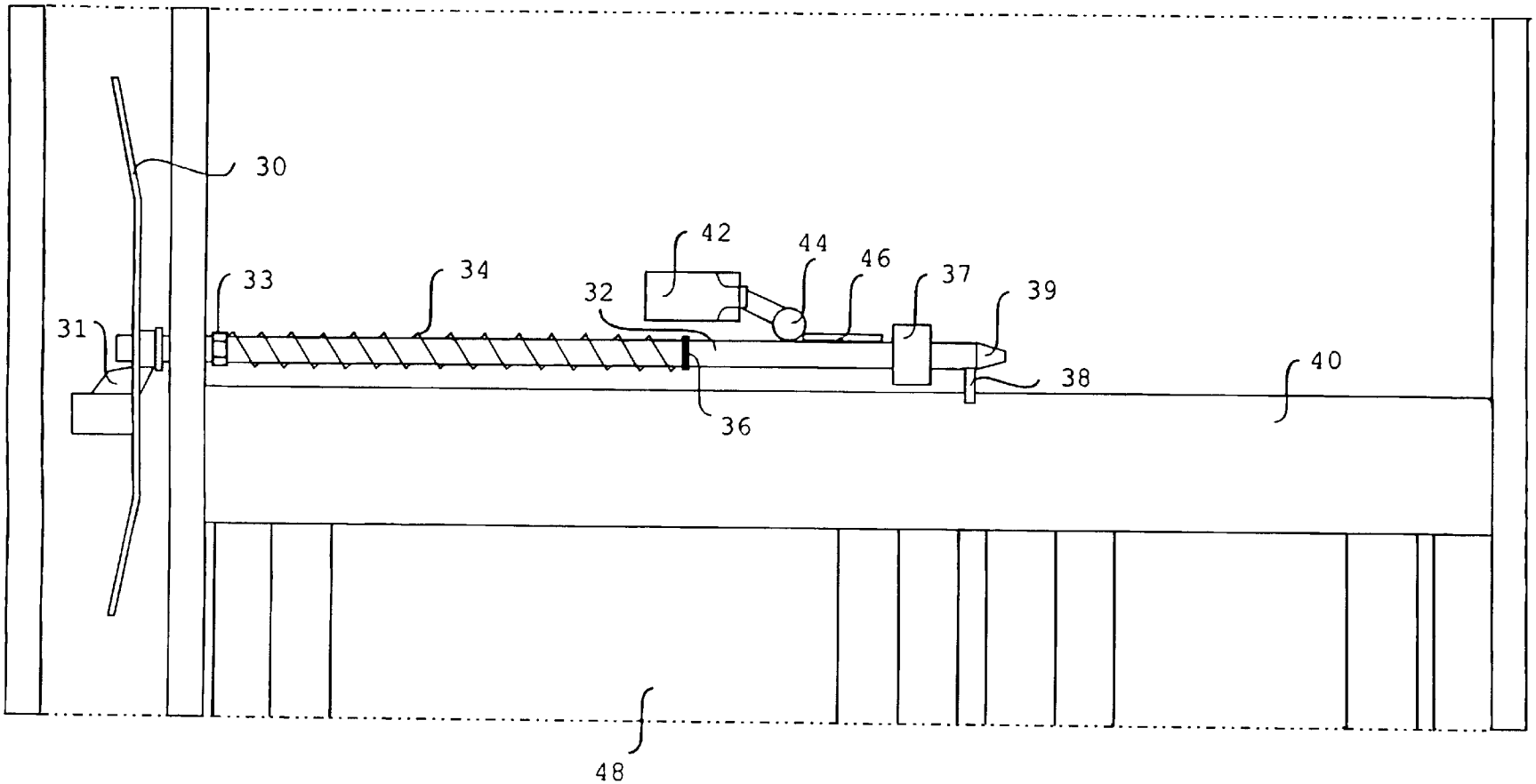

FIG. 1 is a top view of the lift interlocking mechanism of the invention, mounted on a lift cage and at landings, respectively, several members being removed from these elements, FIG. 2 is a side view, seen from line II—II in FIG. 1, of the components disposed on the lift roof, and FIG. 3 is a side view, seen from line III—III in FIG. 1, of the components provided at a landing for interlocking and for release of the interlocking of landing door provided at this landing.

Principally, the interlocking mechanism of the invention comprises two main parts, one of which is attached to the lift cage 1, of which only a limited portion is shown, the other of which is fixed at a landing.

The lift cage part consists of a linear actuator 2, fixed to the lift cage by means of fittings 6. The actuator 2 comprises a cylinder and a piston rod 4, linearly displaceable in the cylinder. In this case the cylinder has an electric drive motor, not shown, driving an axially fix rotatable nut, which engages the at least partly as a screw formed piston rod 4. Of course, instead of an electrically driven screw and nut mechanism, conventional pneumatic or hydraulic cylinders may be provided as actuators. The motor is actuated by a sensing and control system, not shown, which will sense when the lift cage is at rest at a landing. The end of the piston rod 4 acts against a locking rod 8 extending generally in parallel to the piston rod 4 by means of a L-formed member 10, welded to the locking rod 8 (cf. FIG. 2), the locking rod 8 and the L-member being guided in a fix guide 16, designed in correspondence to these components. The locking rod 8 is additionally guided at one end in a bush 22, attached to the lift cage, so that it is axially displaceable in parallel to the roof of the lift cage 1.

The end 5 of the locking rod 8, situated at the the operating member 2 is tapered for facilitating the insertion thereof into a recess or an opening in a securing plate 11 for the lift cage door. Additionally, at a middle portion of the axial rod 8 a radial shoulder or collar 23 is provided, serving as a seat for a coil spring 34, disposed on the axial lift locking rod 8, the opposite end of which engages the guide bush 22 or the wall, into which the bush is inserted.

On the end of the axial rod 8, protruding from the bush 22 radially protruding, towards the lift cage, an inclined angular arm 24 is provided, a cam roll being fixed, rotatable about an axis 28. This axis 28 extends generally normal to the locking rod 8.

One leg 12 of the L-member extends vertically upwards from the locking rod 8, so that it will lie in the action line of the piston rod 4, the piston rod 4 thereby axially displacing the L-member 10 and thus the locking rod 8 against the action of the spring 34. However, it should be noted that there is no fix connection between the piston rod 4 and the L-member 10, the locking rod 10 being returned to its locking or start position by the action of the spring 34, only.

The locking rod 8 conventionally cooperates with a securing plate 11, having an open recess or bore. Said plate is in turn connected to a pivotable flap 21, which in a locking position prevents the lift door from being opened. In the release position of the securing plate 11 the flap may be pivoted about the indicated pivots 15*a* and 15*b* to release the lift door to permit the opening thereof. The locking of the lift door does not constitute a part of the present invention, which may be carried out by any known manner and will of that reason not be further discussed hereinafter.

The end of the locking rod 8 is of course adapted to the recess or opening of the securing plate 11, so that it may be inserted without any difficulties into a locking position in case of interlocking, the guidance of the insertion being facilitated by the conically tapered end 5.

The structure of the interlocking mechanism for the landing doors can best be seen in FIG. 3. Principally, it operates in the same manner as the interlocking mechanism for the lift cage door. Thus, for each landing it comprises a landing door locking rod 32, having a conically tapered end 39, which in case of interlocking will be inserted into an appropriate recess or opening in a securing plate 38, which in a locking position, i.e. when the landing door locking rod 32 is inserted in the recess or opening of the securing plate 38, prevents a flap for the locking of the landing door 48 from being displaced from the interlocking position.

Landing door locking rod 32 is displaceable, generally in paralel to the lift door locking rod 8 and is guided at one end in a guide 37 fixedly attached to the landing and at the other end in a bush 33 fixedly connected to the landing. A coil spring, disposed between a fix shoulder 36 on the rod 32 and the bush 33, which serves as a return spring for the rod 32 to its start or interlocking position.

The end of the axial rod 32, situated in vincinity of the bush 33, is provided with a fix cam 30, connected to the end of the rod by a rigid arm 31, in such a manner that the cam 30 is positioned in the path of motion of the cam roll 26 of the lift cage locking rod 8 (in its interlocking position, when the lift cage moves upwardly or downwardly to the different landings) at a longer distance from the lift cage 1 than the cam roll 26.

The interlocking mechanism operates as follows: when the lift cage has stopped in a proper position at a landing, the position is sensed by sensing and control means, not shown, which then activates the actuator 2 to displace the piston rod 4, from its retracted locking position. The latter will act on the L-member 10 so that this together with the lift door locking rod 8 will be displaced to the left in FIG. 2. After a certain distance of displacement the end 5 of the lift cage door locking rod has moved out from the recess or opening of the securing plate 11, thereby releasing the interlocking of the lift cage door and compressing the spring 20. In connection with the axial displacement of the locking rod 8, the cam roll 26 will be displaced, as well, and engage the cam 30 of the landing, which, while compressing the coil spring 34, will be displaced to the left in FIG. 3, so that finally the locking rod of the landing disengages the securing plate 38.

Thereby, the interlockings of the lift cage door as well as of the door at the landing in question are released, said doors now being openable.

Preferably, sensors are provided, which sense and deliver signals to the control system of the lift about the interlocking condition, since it should not be possible to start the lift, if not the interlocking state has occurred. Of this reason one end of the L-member 10 has a guide 14 similar to a ramp, which will be engaged by the sensing rolL 19 of a sensor 17 attached to the lift cage. Similarly, a sensor 42 is provided for the interlocking of the landing door 48, the sensing roll 44 will engage a cam provided on the locking rod 32 for landing door.

Thus, when the actuator has reached its end position, it will be indicated that the locking rods have reached their opening positions, the power supply to the drive means being interrupted. In case of power failure the piston rod 4 will maintain its reached end position.

If the lift cage should move to another landing, first the doors must be shut and interlocking occur, if power should be supplied to the drive means. When the doors are shut a start control means is actuated, acuator of the interlockings being activated in the retraction direction. The compressed coil springs then will return the locking rods 8, 32, as the return movement of the piston rod 4 permits their returns, so that they will engage their respective securing plates 11, 38. The sensors 17, 42 are arranged so that they will deliver signals to the control equipment of the lift, when this situation is present, the control equipment activating the drive means so that the lift cage 1 moves. Further it should be noted that the securing plates 11, 38 also serve to prevent the locking rods from returning, if the actuator of any reason has returned and the respective door is open.

In addition to the above listed advantages of the interlocking mechanism, including amongst other things less sensivity to wear and positionings, the easy possibility of opening in emergency situations should be mentioned. As should be realised, the locking rods are displaceable against the action of the springs 20 and 34, without need of activating the actuator 2.

Further it almost goes by iself that the cam 30 of the landing only has a limited vertical extension and that it is positioned within a limited, allowable opening area in the height direction between the lift cage 1 and the landing.

I claim:

1. An interlocking mechanism for an elevator with a lift cage having interlocking of the lift cage door and with a landing door at each landing having interlocking of the landing door, said interlockings being in locking positions, when the lift cage is moving or is beyond a landing, and being releasable, when the lift cage is at rest at a landing, said mechanism comprising an actuator means, which in a single operational movement may release the interlocking of the lift cage door as well as the interlocking of the landing door characterized in that the actuator means is disposed to axially displace a lift cage door locking rod, comprised in the interlocking of the lift cage door, substantially horizontally out of engagement with a lift cage door locking means and in that the lift cage door locking rod is disposed to cooperate with and displace a landing door locking rod, provided at each landing, and axially displaceable in parallel to the lift cage door locking rod, out of engagement with a landing door locking means, provided at each landing, when the lift cage is at rest at a respective landing.

2. An interlocking mechanism as in claim 1, characterized in that the locking rod of the lift cage door and each landing door locking rod are biased by respective springs towards the interlocking position.

3. An interlocking mechanism as in claim 1, characterized in that each landing door locking rod is rigidly connected to a landing cam, provided at each landing, and which is disposed to be displaced by the locking rod of the lift cage door for disengaging the locking rod of the landing door from its engagement with the locking means of the landing door, when the lift cage is in its rest position at a respective landing.

4. An interlocking mechanism as in claim 3, characterized in that the landing cam extends vertically over a limited, allowable area, only, wherein it may be displaced by the locking rod of the lift cage door.

5. An interlocking mechanism as in claim 3, characterized in that the end of the locking rod of the lift cage remote from the lift cage door locking means, carries a roll, which will be engaged with the landing cam for displacing the respective locking rod of the respective landing out of engagement with the locking means of the landing door upon displacement of the locking rod of the lift cage door.

* * * * *